US006286431B1

(12) United States Patent
Cangelosi

(10) Patent No.: US 6,286,431 B1
(45) Date of Patent: Sep. 11, 2001

(54) OPEN LOOP MINESWEEPING SYSTEM

(75) Inventor: Joseph S Cangelosi, Levittown, NY (US)

(73) Assignee: Edo Corporation, North Amityville, NY (US)

( * ) Notice: Subject to any disclaimer, the term of this patent is extended or adjusted under 35 U.S.C. 154(b) by 0 days.

(21) Appl. No.: 09/545,820

(22) Filed: Apr. 7, 2000

(51) Int. Cl.[7] ..... B63G 7/06; B63G 7/08
(52) U.S. Cl. ..... 102/402; 89/1.13
(58) Field of Search ..... 102/402, 403; 89/1.13; 114/221 R

(56) References Cited

U.S. PATENT DOCUMENTS

| | | | | |
|---|---|---|---|---|
| 2,994,268 | * | 8/1961 | Watson | 102/7 |
| 3,060,883 | * | 10/1962 | Herbst et al. | 114/221 |
| 3,940,732 | * | 2/1976 | Hudson et al. | 340/4 E |
| 3,946,696 | * | 3/1976 | Lubnow | 114/221 R |
| 4,627,891 | * | 12/1986 | Gibbard | 204/1 R |
| 4,697,522 | * | 10/1987 | Groschupp et al. | 102/402 |
| 4,938,136 | * | 7/1990 | Gould | 102/406 |
| 5,063,850 | * | 11/1991 | Olsson et al. | 102/402 |
| 5,277,117 | * | 1/1994 | Bender et al. | 102/402 |
| 5,323,726 | * | 6/1994 | Olsson | 114/221 |
| 5,598,152 | * | 1/1997 | Scarzello et al. | 340/850 |
| 6,213,021 | * | 4/2001 | Pickett | 102/402 |

* cited by examiner

*Primary Examiner*—Charles T. Jordan
*Assistant Examiner*—Kimberly S Smith
(74) *Attorney, Agent, or Firm*—Kilgannon & Steidl

(57) ABSTRACT

An open loop magnetic field minesweeping system, with a small and light weight body to be towed through seawater by a helicopter or other vehicle, hydrodynamic control surfaces on the body, a single sweep cable extending a substantial distance from the body with a first electrode in cable, sleeve or sock form attached to the end of the sweep cable, and a second electrode provided on the body as part of its skin. A rectifier and transformer on the body convert AC power fed to the towed body from the towing vehicle, to DC power applied to the first electrode. The rectifier and transformer are encapsulated by a thin waterproof layer and directly exposed to the sea water for cooling through the layer. The body may have a winch to deploy and retrieve the first electrode. Acoustic transducers may be mounted on or within the body.

8 Claims, 3 Drawing Sheets

OPEN LOOP MINESWEEPING SYSTEM

FIELD OF THE INVENTION

The present invention relates to minesweeping equipment, and more particularly to equipment that will clear a shallow body of water of mines that can be set off by influence signatures.

BACKGROUND OF THE INVENTION

A minesweeping system that creates influence signatures generally must provide a large enough influence field to be effective while still minimizing the size and weight of the equipment to make the system practical from the standpoint of the platform which controls and/or tows the system. This platform may be a ship, a helicopter, a remote controlled vehicle operating above or below the water surface, or a slow moving aircraft. Minesweeping systems to date have therefore involved a trade-off of performance vis-a-vis size and weight.

Prior art systems to date have included sweep systems using open loop magnetic technology, wherein electrical current is distributed between two or more towed electrodes and the intervening seawater between the multiple electrodes is used as the electrical return. One such system, the Mk-105, utilizes a hydrofoil vehicle towed by a helicopter with a gas turbine power plant on the hydrofoil to generate electricity for the open loop electrodes. The Mk-105 system is powerful, but also quite large and heavy, thus requiring the hydrofoil vehicle. In general, however, the most efficient means to achieve a large magnetic field is to use the open loop means of generating the field. Thus, a ship or helicopter-hydrofoil system has generally been required for the towing. Further, such open loop systems require sufficient physical handling equipment to handle the two or more electrodes, including the appropriate deployment and retrieval of the multiple electrodes as well as maintaining the multiple electrodes separated from one another for proper functioning and to avoid tangle.

An alternative prior art sweep system, for example the SWIMS system, generates the magnetic influence field utilizing conventional dipole technology with large magnetic cores. Because of the size and weight associated with this technology, however, the magnetic field is limited by the size and weight of a practical towed body in which the system is housed.

Still further prior art minesweeping systems have involved various coils or permanent magnet solutions which also have size and weight problems that result in limited field strength.

Various prior art minesweeping and other marine systems are also illustrated in U.S. Pat. Nos. 2,393,466; 2,937,611; 3,060,883; 3,273,110; 3,938,459; 3,940,732; 4,562,789; 4,627,891; 4,697,522; 5,001,485; 5,063,850; 5,323,726; and 5,941,744.

SUMMARY OF THE INVENTION

The present minesweeping invention is intended to utilize the open loop means of generating the magnetic field to obtain a powerful field, while overcoming the deficiencies of the prior art to provide a smaller system, a lightweight system, and a system that simplifies electrode handling. The present invention is sufficiently small and stable that it can be utilized with and towed by smaller helicopters, smaller water vehicles or remotely operated vehicles. The invention is particular adapted to littoral operation, for example to clear mined ports or offshore areas or off a beachhead where it is desirable to minesweep the shallow waters in preparation for landing craft.

The present invention includes a body to be towed in the water, the body containing hydrodynamic control surfaces and designed to provide a high-speed and stable tow. The body provides the means to generate the magnetic influence signatures, and the body may also include transducers to generate acoustic influence signatures. A significant aspect of the present invention is that the towed body does not tow multiple electrodes to generate magnetic signatures, but rather only tows one (the first) electrode while still using an open loop means of generating the magnetic field. This is accomplished by having the towed body function as the other (the second) electrode, either by making the skin of the body the electrode, or by having removable electrode panels on the skin of the towed body, or perhaps by incorporating pieces of standard electrode designs into the body. Thus the towed body only has one cable which contains the first electrode extending behind the towed body. The physical handling equipment for the single cable is thus considerably simplified as contrasted with what is needed for open loop systems handling and towing multiple cables, each with electrodes.

Open loop power and control systems generally provide an input AC power which is then rectified to DC power and controlled to either continuous level or to relatively low frequency (pulsed) waveforms. This rectification and conditioning generally are done on the primary towing platform, i.e., the helicopter or ship, which requires weight and space, and requires large diameter cables to handle and pass the large DC currents associated with open loop sweeps. Particularly when the primary towing vehicle is a helicopter, the cable with DC power from the helicopter to the towed body is in air and thus presents difficulties in cooling absent such a large diameter cable. Accordingly, in a further aspect of the present invention, AC input power of low amperage and high voltage is passed from the primary towing platform to the towed body, enabling the use of a lower weight cable of small diameter that can be handled by a small helicopter. The AC power is then transformed and rectified at the towed body.

Although the transformer and rectifier components would normally generate excessive and damaging heat at the towed body, the heat is dissipated in the present invention by exposing the transformer and rectifier components at the towed body directly to the sea water. These components are not retained within a watertight enclosure with cooling mechanisms, but are encapsulated within a thin waterproof coating directly exposed to the sea water, the coating protecting the components from the conductive sea water but otherwise cooling the components by passing heat through the thin coating directly to the sea water. Maximum cooling is obtained, and the components can be of significantly reduced size and weight from that which would be required by alternative forms of cooling at the towed body.

The body to be towed also may contain a winch to deploy and return the first electrode. The first electrode also may take alternative forms, such as a cable, a rigid sleeve, or a flexible sock.

Other features and advantages of the present invention will be apparent from the following description, drawings and claims.

DETAILED DESCRIPTION OF EMBODIMENTS

Figure 1:
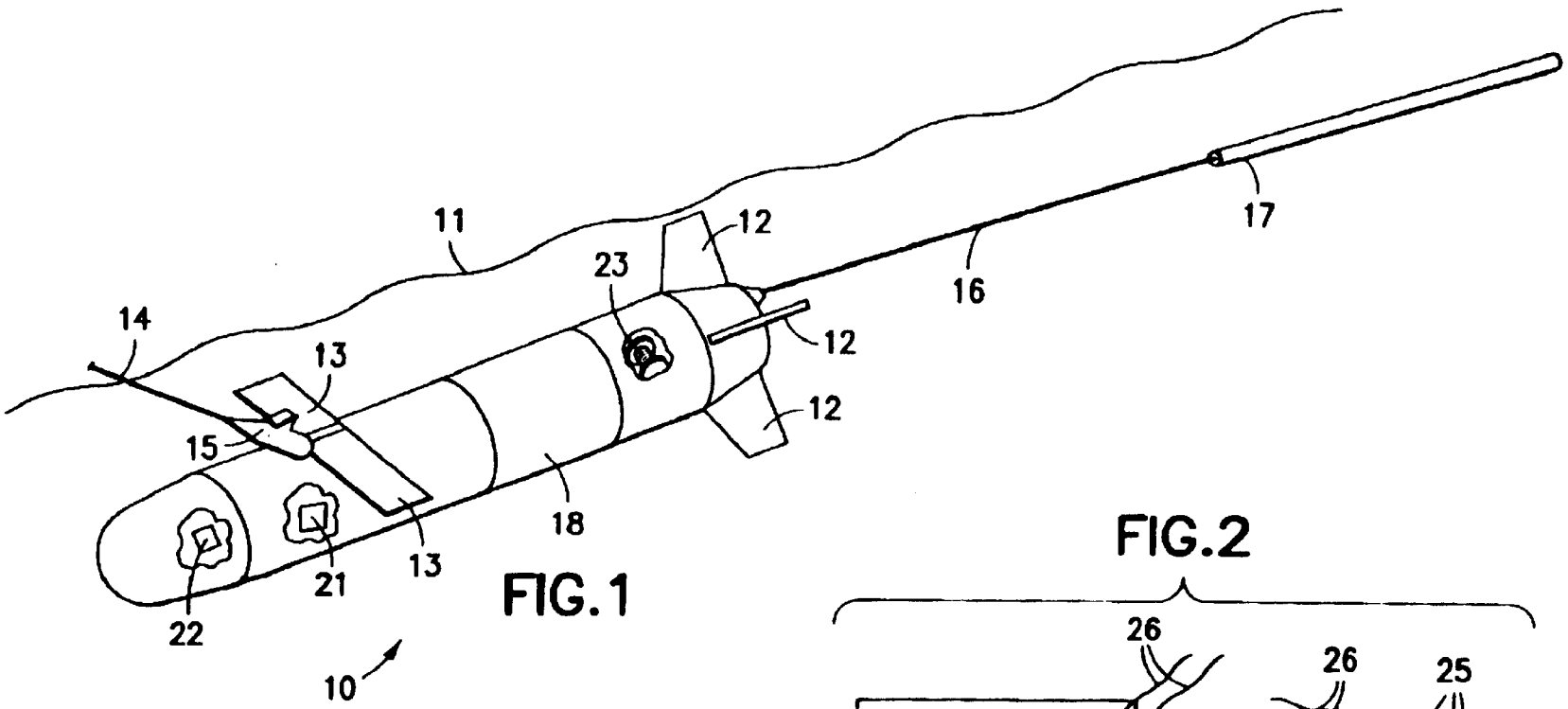
FIG. 1 is a perspective view of the present invention as it would be towed through the sea water.

Referring to FIG. 1, towed body 10 is illustrated which is generally shaped in a torpedo-like, streamlined fashion for smooth, fast and stable passage through the seawater 11. Body 10 when towed may be submerged, and includes rear hydrodynamic fins 12 and possibly hydrodynamic wings 13 to control the orientation, depth and direction of the towed body. As illustrated, tow cable 14 is connected at one end to the towed body 10 at connector mechanism 15, and the other end of tow cable 14 may be connected to a winch mechanism on the towing platform (for example on a towing helicopter, not shown). The towing platform also will have means to cradle and carry the towed body 10 when not in minesweeping use from one location to another. The towing platform additionally will have power means to provide AC power of low amperage and high voltage down tow cable 14 to the towed body 10. As previously noted, the providing of AC power of low amperage to the towed body allows the power cable along tow cable 14 to be of small diameter and light weight as compared to cables providing high DC current from the towing platform to the towed body.

Extending rearwardly from towed body 10 when it is in minesweeping operation is an insulated and waterproof, sweep separation cable 16 and the aft (first) anode electrode 17 in cable form. Cable 16 and electrode 17 may be non-buoyant to minimize size and drag, and are of standard known design. The open loop magnetic method of minesweeping requires a second electrode, but in the present invention, there is no towed second electrode. Rather, a cathode electrode 18 is shown in FIG. 1 as part of the outer skin of the towed body. Cathode 18 may be constructed of metal plate, or alternatively as wires or metal braid, or sections of cable electrode, connected on the outside surface of the towed body 10, for example. Cathode electrode 18 is of course insulated from electrode 17, and the return path from electrode 17 to electrode 18 is through the intervening sea water 11. It will be apparent that there are not two towed cables to be separately handled and maintained in a tangle-proof state.

Figure 2:
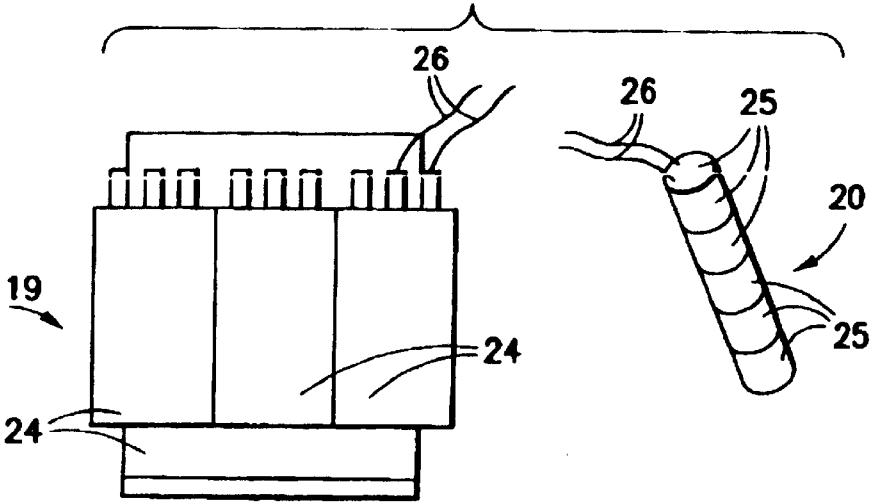
FIG. 2 illustrates the power conversion elements of the present invention.

DC electrical power as noted is provided across electrodes 17 and 18 for the open loop magnetic method of minesweeping. Since AC power of low current and high voltage is provided to towed body 10 along tow cable 14, the high voltage, low current AC is transformed to low voltage, high current AC at the towed body 10 by transformer 19, and is then rectified by rectifier 20 to provide the constant level or pulsed DC power required. The power conversion electrical elements are shown schematically at cut-out 21 in FIG. 1, and as transformer 19 and rectifier 20 in FIG. 2.

Additionally illustrated schematically in FIG. 1 at cut-out 22 is an electrodynamic acoustic device that may take various well-known forms such as an electrodynamic moving coil transducer. One or more such transducers may be located in towed body 10. Accordingly, towed body 10 provides complementary magnetic and acoustic influence signatures for minesweeping. The acoustic source generally will produce a sweep path width that equals or exceeds the magnetic sweep path width, in order to deal with dual influence mines typically found in shallow water.

The sweep cable 16 and aft electrode 17 may be stowed on a small winch 23 contained within an open and hollow rear end of towed body 10, cable 16 and electrode 17 being deployed therefrom to the FIG. 1 position during minesweeping and reeled back into towed body 10 after use prior to retrieval of towed body 10. The winch 23 may be controlled from control signals from the towing platform.

Figure 3:
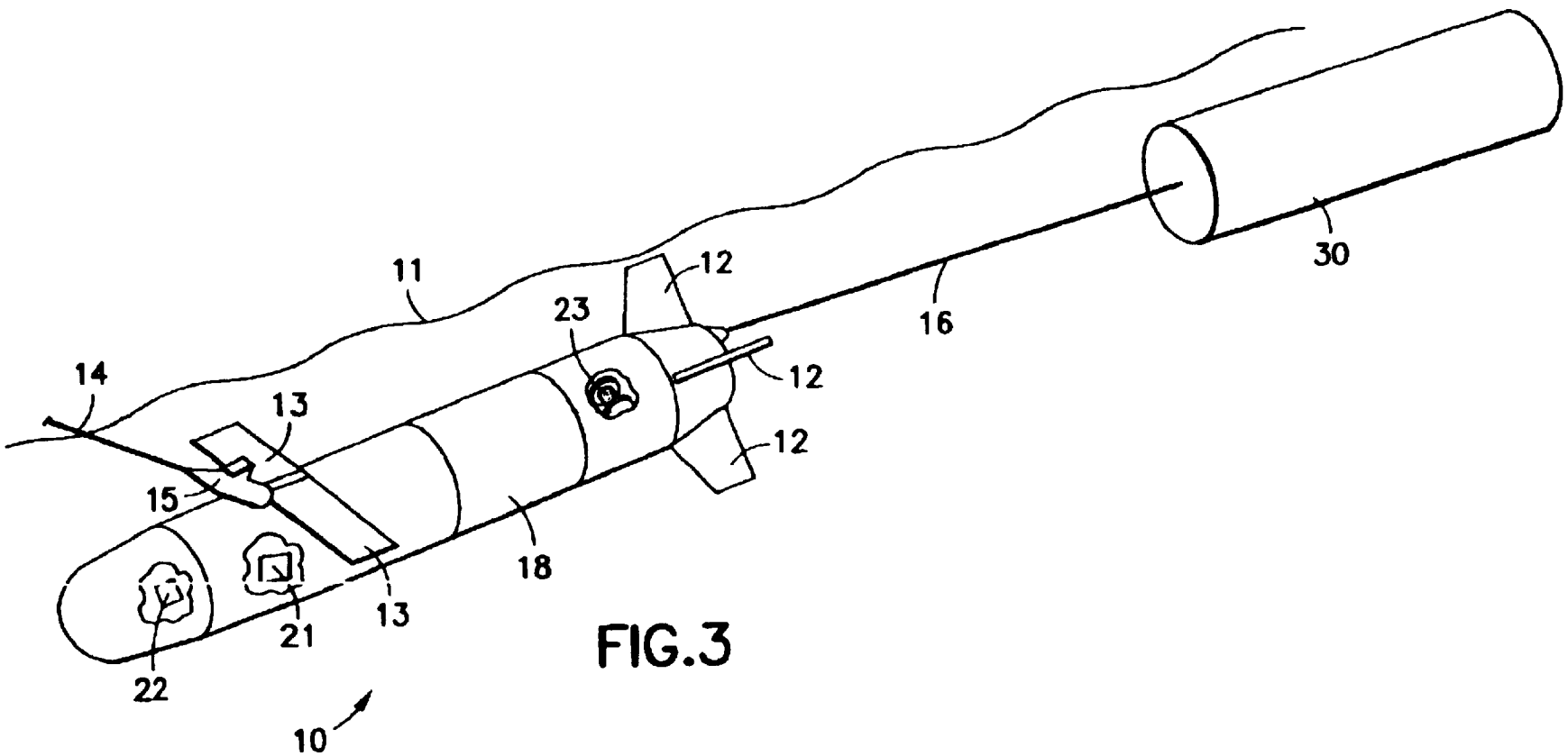
FIG. 3 illustrates a first alternative form of the single deployed electrode of the present invention.
Figure 4:
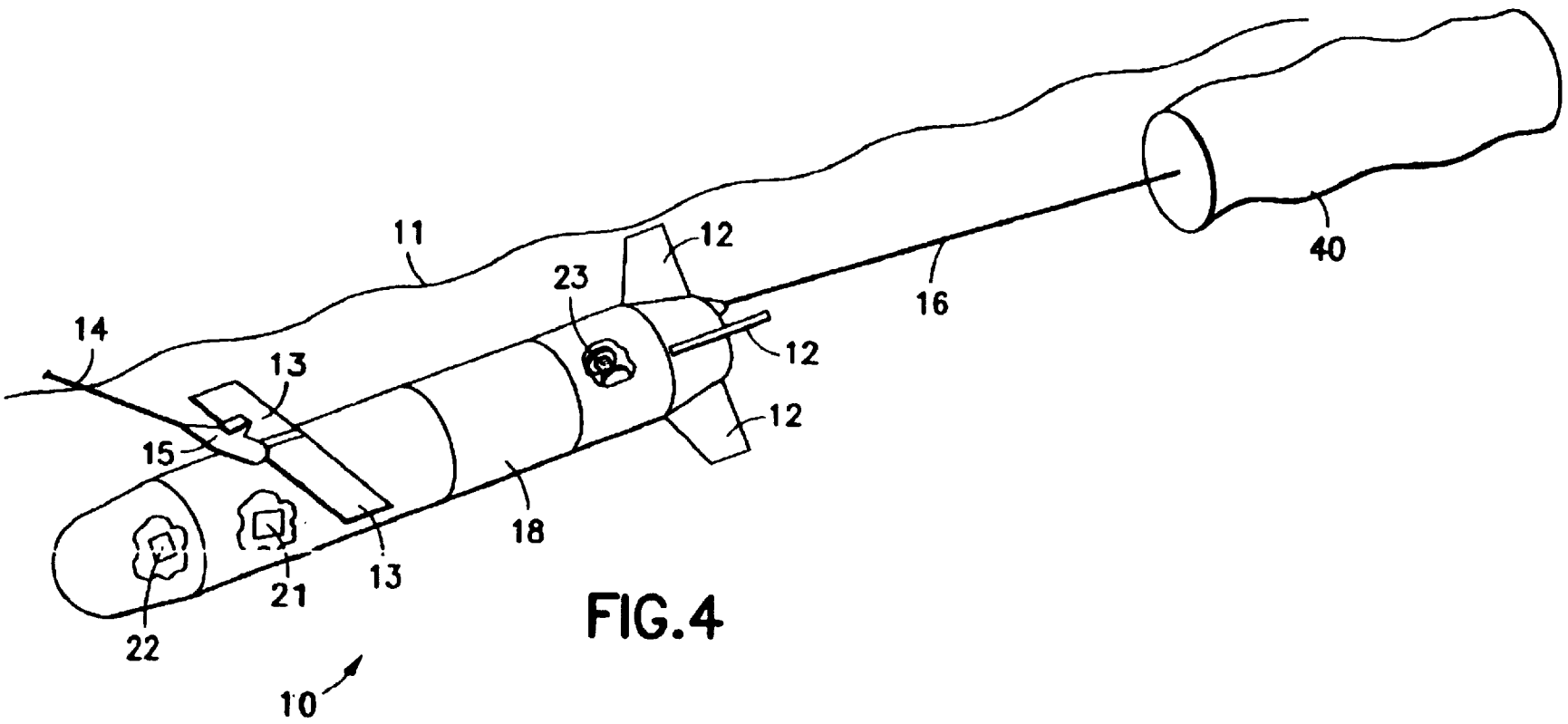
FIG. 4 illustrates a second alternative form of the single deployed electrode of the present invention.

Alternative forms to aft electrode 17 are illustrated in FIGS. 3 and 4. FIG. 3 illustrates aft electrode 30 configured as a rigid sleeve of larger diameter and shorter length than electrode 17. The shorter length is a function of having more surface area by virtue of the larger diameter of the electrode. From the perspective of system resistance of the water interface of the aft electrode, a primary factor is the wetted surface area of the electrode. Thus the larger diameter and shorter sleeve electrode obtains the same result as a smaller diameter and longer cable electrode. Electrode 30 may assume the same dimensions as the forward skin electrode 18 of FIG. 1 for example, and may also be retrieved by winch 23 into an open and hollow end of towed body 10.

FIG. 4 is an alternative form to FIG. 3, wherein electrode 40 is similar in deployed dimension to electrode 30 of FIG. 3 but is flexible like a windsock so that it can flatten and be easily rolled up into towed body 10 by winch 23 on retrieval.

Referring back to FIG. 2, transformer 19 and rectifier stack 20 generate considerable heat in operation. Rather than utilizing enclosed waterproof boxes and cooling plates aboard towed body 10, the transformer 19 and rectifier 20 are each completely encapsulated within very thin and conformal waterproof coatings 24, 25 respectively of material which may for example be a moldable polymer. The sealed transformer 19 and rectifier 20 are in turn mounted on towed body 10 so that the encapsulation layers 24, 25 are directly exposed to the sea water, thereby allowing heat conduction directly through the thin layers 24, 25 to the sea water. The transformer 19 and rectifier 20 may for example be mounted in an internal cavity of body 10, which cavity is flooded with sea water. Alternatively, they may be mounted in a pocket in the side wall of towed body 10 exposed to the sea water. Alternatively a tunnel may pass through a portion of towed body 10 through which sea water passes, the transformer 19 and rectifier 20 then being mounted within or on the side wall of said tunnel. Waterproof pigtails 26 shown schematically in FIG. 2 in turn pass between transformer 19 and rectifier 20 respectively and the power connections internal to towed body 10. This cooling aspect of the present invention provides for very efficient cooling and component design to minimize size and weight on the towed body 10.

Solely as an exemplary embodiment of one form of the present invention, the following parameters may apply:

| | | |
|---|---|---|
| Length of towed body 10 | 10 | feet |
| Diameter of towed body 10 | 18 | inches |
| Length of sweep cable 16 | 250 | feet |
| Length of anode electrode 17 | 150 | feet |
| Diameter of cable 16 and electrode 17 | .65 | inches |
| Length of cathode electrode | 5 | feet |
| AC power along towing cable 14 | 19 | kilowatts |
| DC current to anode electrode 17 | 400 | amps |
| DC power to anode electrode 17 | 16 | kilowatts |
| Weight (in air) of towed body | 1000 | pounds |
| Tow speed of system | Up to 50 | knots |

-continued

| | |
|---|---|
| Field strength | 4 MGauss |
| Weight (in air) of cable 16 and electrode 17 | 230 pounds |

It will be seen from the above parameters that a very light weight, small size open loop magnetic field system is provided, including simplified electrode handling and efficient cooling.

It will be appreciated by persons skilled in the act that numerous variations and/or modifications may be made to the invention without departing from the spirit and scope of the invention. The present embodiments are, therefore, to be considered as illustrative and not restrictive.

What is claimed is:

1. An open loop magnetic field minesweeping system utilizing sea water as part of the electrical conductive path, comprising a small, light weight, streamlined body to be towed through sea water by a helicopter, other aircraft vehicle or marine vehicle; said body having a connector for connecting a towing and electrical power-providing cable from the towing vehicle to the body; said body having hydrodynamic control surfaces; a single insulated and waterproof sweep cable adapted to extend a substantial distance rearwardly in the water from the body and a first electrode connected to the sweep cable for extending a substantial distance rearwardly in the water from the sweep cable; a second electrode positioned on the body to be towed; and power conversion electrical elements contained within the body to be towed for converting AC power fed to the electrical elements from the towing vehicle to DC power provided to the first electrode through the insulated sweep cable.

2. The invention of claim (1), wherein the power conversion electrical elements on the body to be towed comprise a transformer and rectifier, both of which are encapsulated by a thin waterproof layer of material, said encapsulated transformer and rectifier being mounted on the body so as to be directly exposed to sea water to cool the transformer and rectifier through the encapsulation layer.

3. The invention of claim (1), wherein the first electrode is a cable electrode of substantially the same diameter as the sweep cable.

4. The invention of claim (1), wherein the first electrode is a rigid sleeve of larger diameter than the sweep cable.

5. The invention of claim (1), wherein the first electrode is a flexible sock of larger diameter than the sweep cable.

6. The invention of claim (3) or (4) or (5), wherein the body to be towed contains a winch to deploy and retrieve the first electrode.

7. The invention of claim (1), wherein the body contains one or more acoustic devices to generate acoustic influence signatures.

8. The invention of claim (1), wherein the second electrode forms part of the outer surface of the body.

* * * * *